US010247454B2

(12) United States Patent
Sugimoto et al.

(10) Patent No.: US 10,247,454 B2
(45) Date of Patent: Apr. 2, 2019

(54) REFRIGERATING APPARATUS

(71) Applicant: Mitsubishi Electric Corporation, Tokyo (JP)

(72) Inventors: Takeshi Sugimoto, Tokyo (JP); So Nomoto, Tokyo (JP); Tomotaka Ishikawa, Tokyo (JP); Takashi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/820,724

(22) Filed: Nov. 22, 2017

(65) Prior Publication Data

US 2018/0106514 A1 Apr. 19, 2018

Related U.S. Application Data

(62) Division of application No. 14/401,674, filed as application No. PCT/JP2012/070969 on Aug. 20, 2012.

(51) Int. Cl.
*F25B 41/04* (2006.01)
*F25B 25/00* (2006.01)
(Continued)

(52) U.S. Cl.
CPC ..... *F25B 41/04* (2013.01); *F25B 1/10* (2013.01); *F25B 7/00* (2013.01); *F25B 25/005* (2013.01); *F25B 49/02* (2013.01); *F25B 6/04* (2013.01); *F25B 43/006* (2013.01); *F25B 45/00* (2013.01); *F25B 2341/0662* (2013.01); *F25B 2500/07* (2013.01); *F25B 2500/26* (2013.01);
(Continued)

(58) Field of Classification Search
CPC ..... F25B 1/10; F25B 43/006; F25B 45/00; F25B 49/02; F25B 2341/0662; F25B 2500/07; F25B 2500/26; F25B 2700/1931; F25B 2700/1933; F25B 2345/00
See application file for complete search history.

(56) References Cited

U.S. PATENT DOCUMENTS 5,829,262 A * 11/1998 Urata ..... F25B 9/006 62/174
6,539,735 B1 4/2003 Schmidt
2010/0326100 A1* 12/2010 Taras ..... F25B 1/10 62/115

FOREIGN PATENT DOCUMENTS

JP 32-068459 A 3/1990
JP H10-267441 A 10/1998
JP 2003-074999 A 3/2003
JP 2003-279202 A 10/2003
(Continued)

OTHER PUBLICATIONS

JP 2006-290042 (English Translation).*
(Continued)

*Primary Examiner* — Jonathan Bradford
(74) *Attorney, Agent, or Firm* — Posz Law Group, PLC

(57) ABSTRACT

A refrigerating apparatus includes a high-temperature side circuit and a low-temperature side circuit connected to each other via a cascade condenser, a low-temperature side second flow control valve that turns a refrigerant, passing through a liquid pipe connecting between a cooling unit and other circuit parts in a low-temperature side circuit b, into a gas-liquid two-phase refrigerant, and an expansion tank connected to the suction side of a low-temperature circuit compressor via a tank electromagnetic valve.

4 Claims, 5 Drawing Sheets

(51) Int. Cl.

| | |
|---|---|
| ***F25B 7/00*** | (2006.01) |
| ***F25B 49/02*** | (2006.01) |
| ***F25B 1/10*** | (2006.01) |
| *F25B 43/00* | (2006.01) |
| *F25B 6/04* | (2006.01) |
| *F25B 45/00* | (2006.01) |

(52) U.S. Cl.
CPC ..... *F25B 2600/2513* (2013.01); *F25B 2600/2519* (2013.01); *F25B 2700/1931* (2013.01); *F25B 2700/1933* (2013.01)

(56) References Cited

FOREIGN PATENT DOCUMENTS

| | | | |
|---|---|---|---|
| JP | 2004-183909 | A | 7/2004 |
| JP | 2004-190917 | A | 7/2004 |
| JP | 2004-279014 | A | 10/2004 |
| JP | 2006-290042 | A | 10/2006 |
| JP | 2012-112622 | A | 6/2012 |

OTHER PUBLICATIONS

International Search Report of the International Searching Authority dated Sep. 25, 2012 for the corresponding international application No. PCT/JP2012/070969 in connection with related U.S. Appl. No. 14/401,674 (and English translation).

Office Action dated Jun. 9, 2015 in corresponding JP patent application No. 2014-531399 in connection with related U.S. Appl. No. 14/401,674 (and English translation).

Office Action dated Aug. 28, 2015 in corresponding CN patent application No. 201280073542.0 in connection with related U.S. Appl. No. 14/401,674 (and English translation).

Office Action dated Sep. 1, 2015 in corresponding JP patent application No. 2014-531399 in connection with related U.S. Appl. No. 14/401,674 (with English translation).

Extended European Search Report dated May 17, 2016 issued in corresponding EP patent application No. 12883244.1 in connection with related U.S. Appl. No. 14/401,674.

* cited by examiner

REFRIGERATING APPARATUS

CROSS REFERENCE TO RELATED APPLICATIONS

The present application is a divisional application of U.S. utility application Ser. No. 14/401,674 filed on Nov. 17, 2014, which is a U.S. national stage application of PCT/JP2012/070969 filed on Aug. 20, 2012, the contents of which are incorporated herein by reference.

TECHNICAL FIELD

The present invention relates to a refrigerating apparatus.

BACKGROUND

A refrigerating apparatus has thus far been known that includes a low-temperature side circuit in which a low-temperature circuit refrigerant circulates and a high-temperature side circuit in which a high-temperature circuit refrigerant circulates, the circuits being connected via a cascade condenser. In this type of refrigerating apparatus, when a low-temperature circuit compressor of the low-temperature side circuit stops working the refrigerant is warmed to a temperature close to the ambient temperature and thus gasified, and therefore the pressure in the low-temperature side circuit increases. Accordingly, in the case where the low-temperature circuit compressor is not operated for a long time the pressure in the low-temperature side circuit reaches the design pressure (maximum permissible pressure), which may provoke abnormal non-operation of operation or activation of a safety valve for discharging the refrigerant.

Accordingly, a refrigerating apparatus has been proposed that includes an expansion tank for preventing the pressure in the low-temperature side circuit from exceeding the design pressure, where the low-temperature circuit compressor having been not operated for a long time (see, for example, Patent Literature 1).

PATENT LITERATURE

Patent Literature 1: Japanese Unexamined Patent Application Publication No. H10-267441 (page 5, FIG. 1)

According to Patent Literature 1, the expansion tank serves to prevent the pressure in the low-temperature side circuit from exceeding the design pressure, even though the low-temperature circuit compressor is not operated for a long time. However, in order to suppress the increase in pressure in the low-temperature side circuit it is necessary to give a sufficient capacity to the expansion tank (approximately 10 times of the internal volume of the low-temperature side circuit except for the expansion tank, according to Patent Literature 1), which inevitably leads to an increase in cost.

Conversely, increasing the design pressure allows the expansion tank to be formed with a reduced capacity, thereby allowing cost reduction of the expansion tank itself. Nevertheless, in order to increase the design pressure it is necessary to increase the withstand pressure of the low-temperature side circuit and other parts, and consequently the cost is increased any way. Accordingly, although it is effective to set the design pressure at a lower level in order to reduce the cost, the expansion tank inevitably has to be built with a larger capacity when the design pressure is lowered. Thus, it has been difficult to achieve both a lower design pressure and reduction in cost.

SUMMARY

The present invention has been accomplished in view of the foregoing problem, and provides a refrigerating apparatus that enables reduction in both of the design pressure of the low-temperature side circuit and the cost.

In an aspect, the present invention provides a refrigeration apparatus including a high-temperature side circuit including a high-temperature circuit compressor, a high-temperature circuit condenser, a high-temperature side expansion valve, and a high-temperature circuit evaporator of a cascade heat exchanger, the high-temperature side circuit being configured for a high-temperature circuit refrigerant to circulate therein; a low-temperature side circuit including a low-temperature side heat source circuit including a low-temperature circuit compressor, a low-temperature circuit condenser of the cascade heat exchanger, and a receiver, and a cooling unit including a first flow control valve and a low-temperature circuit evaporator connected in series to each other, the low-temperature side circuit being configured by connecting the low-temperature side heat source circuit and the cooling unit via a liquid pipe for supplying the refrigerant from the low-temperature side heat source circuit to the cooling unit and a gas pipe for supplying the refrigerant from the cooling unit to the low-temperature side heat source circuit, the low-temperature side circuit being configured for a low-temperature circuit refrigerant to circulate therein; a second flow control valve provided at an outlet of the receiver to depressurize the refrigerant flowing out of the receiver and supply the refrigerant to the liquid pipe in a gas-liquid two-phase state; and an expansion tank connected to a suction side of the low-temperature circuit compressor in the low-temperature side circuit via a tank electromagnetic valve and configured to suppress an increase in pressure in the low-temperature side circuit during a non-operation period.

With the refrigerating apparatus according to the present invention, the expansion tank, which normally has to be built with a larger capacity when design pressure of the low-temperature side circuit is lowered, can be built with a reduced capacity by turning the refrigerant in the liquid pipe into the gas-liquid two-phase state using the second flow control valve, and therefore reduction in both of the design pressure of the low-temperature side circuit and the cost can be achieved.

DETAILED DESCRIPTION

Embodiment 1

Figure 1:
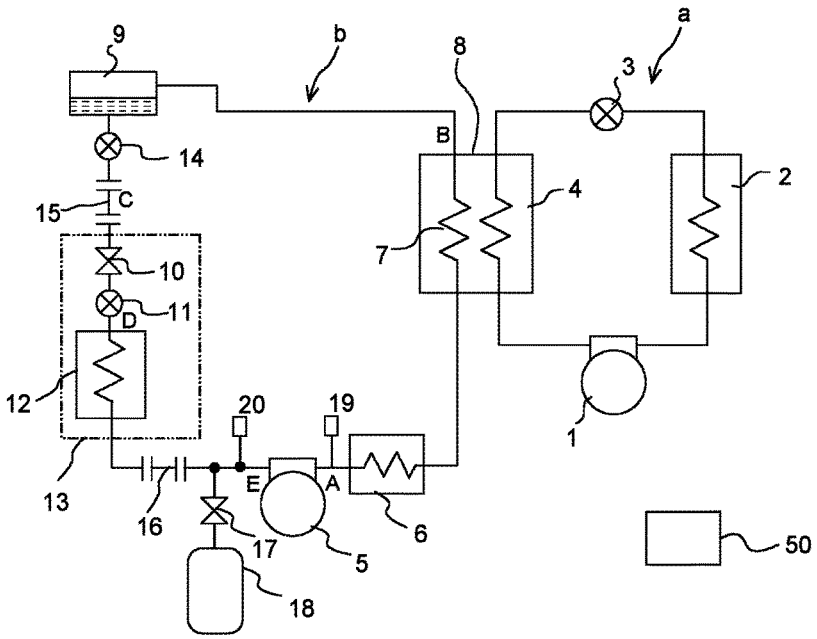
FIG. 1 is a refrigerant circuit diagram of a refrigerating apparatus according to Embodiment 1 of the present invention.

FIG. 1 is a refrigerant circuit diagram of a refrigerating apparatus according to Embodiment 1 of the present invention.

The refrigerating apparatus is configured so as to perform a two-stage refrigeration cycle, and includes a high-temperature side circuit "a" and a low-temperature side circuit b. The high-temperature side circuit "a" includes a high-temperature circuit compressor 1, a high-temperature circuit condenser 2, a high-temperature side expansion valve 3, and a high-temperature circuit evaporator 4 connected in series.

The low-temperature side circuit "b" includes a low-temperature circuit compressor 5, an auxiliary condenser 6, a low-temperature circuit condenser 7, a receiver 9, and a cooling unit 13 connected in series. The low-temperature side heat source circuit according to the present invention at least includes the low-temperature circuit compressor 5, the low-temperature circuit condenser 7, and the receiver 9.

The cooling unit 13 includes a liquid electromagnetic valve 10, a low-temperature side first flow control valve 11, and a low-temperature circuit evaporator 12 connected in series, and is applicable to, for example, a showcase and a unit cooler. The low-temperature side first flow control valve 11 is constituted of a thermostatic automatic expansion valve or an electronic expansion valve. The cooling unit 13 is connected to other circuit parts of the low-temperature side circuit "b" via a liquid pipe 15 and a gas pipe 16. The lengths of the liquid pipe 15 and the gas pipe 16 are adjusted on the actual site where the cooling unit 13 is installed.

In the low-temperature side circuit b, a low-temperature side second flow control valve 14 for adjusting the status of the refrigerant in the liquid pipe 15 is provided at the outlet of the receiver 9. The low-temperature side second flow control valve 14 is, for example, constituted of an electronic expansion valve.

In the low-temperature side circuit b, in addition, an expansion tank 18 is connected to the suction side of the low-temperature circuit compressor 5, via a tank electromagnetic valve 17 to be closed when power is supplied thereto. The expansion tank 18 serves to suppress an increase in pressure in the low-temperature side circuit "b" while the low-temperature side circuit "b" is out of operation, so as to prevent the pressure from exceeding the design pressure (maximum permissible pressure) despite the refrigerant in the low-temperature side circuit "b" being completely gasified.

Further, a low-temperature circuit high-pressure side pressure sensor 19 is provided on the discharge side of the low-temperature circuit compressor 5, and a low-temperature circuit low-pressure side pressure sensor 20 is provided on the suction side of the low-temperature circuit compressor 5.

The cascade condenser 8 is provided in common for the high-temperature side circuit "a" and the low-temperature side circuit b, and includes the high-temperature circuit evaporator 4 and the low-temperature circuit condenser 7. The cascade condenser 8 is, for example, a plate-type heat exchanger, and exchanges heat between the high-temperature circuit refrigerant circulating in the high-temperature side circuit "a" and the low-temperature circuit refrigerant circulating in the low-temperature side circuit b.

In the refrigerating apparatus, a $CO_2$ refrigerant having a global warming potential (GWP) of 1 is employed, because the low-temperature side circuit "b" includes the liquid pipe 15 and the gas pipe 16 and hence a relatively large amount of refrigerant is required and risk of leakage has to be considered. In contrast, the overall pipe length of the high-temperature side circuit "a" is relatively short and hence a small amount of refrigerant is sufficient, and besides the circuit is a closed circuit. Therefore, a refrigerant having a relatively low GWP, though higher than that of $CO_2$ may be employed, such as R410A, R134a, R32, and a HFO refrigerant.

The refrigerating apparatus further includes a controller 50 that controls the entirety of the refrigerating apparatus. The controller 50 is constituted of a microcomputer, and includes a CPU, a RAM, a ROM, and so forth. The controller 50 receives detection signals from the low-temperature circuit high-pressure side pressure sensor 19 and the low-temperature circuit low-pressure side pressure sensor 20, and controls the tank electromagnetic valve 17 according to the detection signal. The controller 50 also controls the low-temperature circuit compressor 5, the liquid electromagnetic valve 10, the low-temperature side first flow control valve 11, the high-temperature circuit compressor 1, and the high-temperature side expansion valve 3, according to outputs from non-illustrated other sensors.

Figure 2:
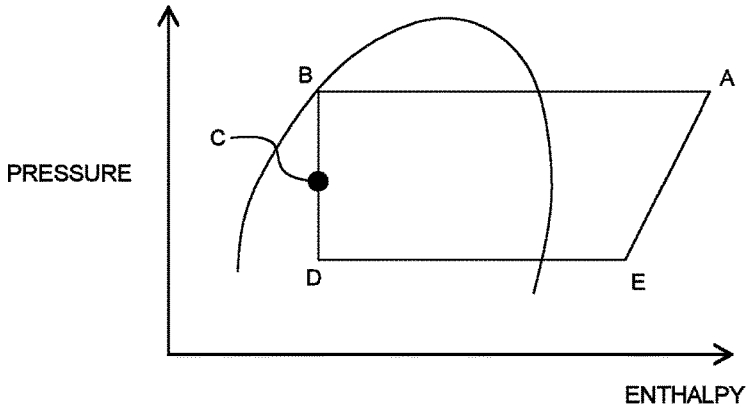
FIG. 2 is a pressure-enthalpy graph representing an operation of a low-temperature side circuit of the refrigerating apparatus shown in FIG. 1.

FIG. 2 is a pressure-enthalpy graph representing an operation of a low-temperature side circuit "b" of the refrigerating apparatus shown in FIG. 1. Points A to E in FIG. 2 indicate the refrigerant status at the respective positions A to E on the pipe in FIG. 1. The point A represents the discharge side of the low-temperature circuit compressor 5, the point B represents the outlet of the low-temperature circuit condenser 7, the point C represents the inside of the liquid pipe 15, the point D represents the inlet of the low-temperature circuit evaporator 12, and the point E represents the suction side of the low-temperature circuit compressor 5. Referring to FIG. 1 and FIG. 2, the operation of the low-temperature side circuit "b" of the refrigerating apparatus will be described hereunder.

The refrigerant sucked into the low-temperature circuit compressor 5 is compressed and turns into a high-temperature/high-pressure gas refrigerant (point A). The high-temperature/high-pressure gas refrigerant is cooled with outside air by the auxiliary condenser 6 (with a non-illustrated fan), thereby releasing heat. Causing thus the refrigerant to pass through the auxiliary condenser 6 allows the heat exchange load of the cascade condenser 8 to be reduced.

After passing through the auxiliary condenser 6, the refrigerant flows into the low-temperature circuit condenser 7 of the cascade condenser 8, and is condensed and liquefied through heat exchange with the high-temperature circuit refrigerant thereby turning into a high-pressure liquid refrigerant (point B). The liquid refrigerant passes through the receiver 9 and is depressurized by the low-temperature side second flow control valve 14 thereby turning into a medium-pressure gas-liquid two-phase refrigerant (point C), and then flows into the cooling unit 13 through the liquid pipe 15.

After entering the cooling unit 13, the refrigerant passes through the liquid electromagnetic valve 10 which is open, and is further depressurized by the low-temperature side first flow control valve 11 (point D), and then flows into the low-temperature circuit evaporator 12. In the low-temperature circuit evaporator 12, the refrigerant exchanges heat with the air in the showcase thereby cooling the internal space of the showcase, and again turns into the low-pressure gas (point E). The refrigerant in the low-pressure gas phase is again sucked into the low-temperature circuit compressor 5 through the gas pipe 16.

On the part of the high-temperature side circuit a, the high-temperature/high-pressure refrigerant discharged from the high-temperature circuit compressor 1 rejects heat in the high-temperature circuit condenser 2. Then the refrigerant flowing out of the high-temperature circuit condenser 2 is depressurized by the high-temperature side expansion valve 3. The refrigerant depressurized by the high-temperature side expansion valve 3 flows into the high-temperature circuit evaporator 4 of the cascade condenser 8 and exchanges heat with the low-temperature circuit refrigerant, thereby evaporating and turning into a low-pressure gas refrigerant, and is then again sucked into the high-temperature circuit compressor 1.

Hereunder, the role of the expansion tank 18, as well as the necessary capacity thereof will be described. First, the condition of the low-temperature side circuit "b" during a long-time non-operation of the refrigerating apparatus will be described.

In the case where the operation is continued on the side of the high-temperature circuit compressor 1 of the high-temperature side circuit "a" while the low-temperature side circuit "b" is out of operation (low-temperature circuit compressor 5 is out of operation) for a long time, the cascade condenser 8 is cooled and therefore the pressure increase in the low-temperature side circuit "b" can be suppressed. However, operating the high-temperature circuit compressor 1 of the high-temperature side circuit "a" while the low-temperature circuit compressor 5 is out of operation (or the thermostat is turned off) for a long time is an operation deviated from the intended purpose of the refrigerating apparatus, that is, lowering the temperature in the showcase. This is a useless operation which should be avoided.

On the other hand, in the case where the high-temperature circuit compressor 1 is not operated either when the low-temperature circuit compressor 5 is out of operation, the pressure in the low-temperature side circuit "b" increases, in a worst case, to the level corresponding to the atmosphere (at the ambient temperature). The $CO_2$ refrigerant employed in the low-temperature side circuit "b" has a boiling point as low as −78.5 degrees C. under atmospheric pressure. Accordingly, when the ambient temperature is in a normal range, such as 25 degrees C., the $CO_2$ refrigerant is gasified in the low-temperature side circuit "b" and hence the pressure in the low-temperature side circuit "b" increases.

Therefore, the expansion tank 18 having a larger volume than the heat exchanger and the receiver 9 is provided for the low-temperature side circuit b, so as to suppress the pressure increase in the low-temperature side circuit "b" when the refrigerant in the low-temperature side evaporation circuit evaporates and is gasified. The size of the expansion tank 18 is determined such that the pressure in the low-temperature side circuit "b" in operation does not exceed the design pressure.

The present invention intends to lower the design pressure of the low-temperature side circuit b. Specifically, it is intended to set the design pressure of the low-temperature side circuit "b" so as not to exceed 4.15 Mpa, which is equivalent to the design pressure in the case of employing R410A, under an ambient temperature of 46 degrees C.

First, the capacity requirement of the expansion tank 18 for setting the design pressure of the low-temperature side circuit "b" so as not to exceed 4.15 Mpa will be described. The capacity requirement differs depending on the state of the refrigerant in the liquid pipe 15 connecting between the cooling unit 13 and the cascade condenser 8.

Figure 3:
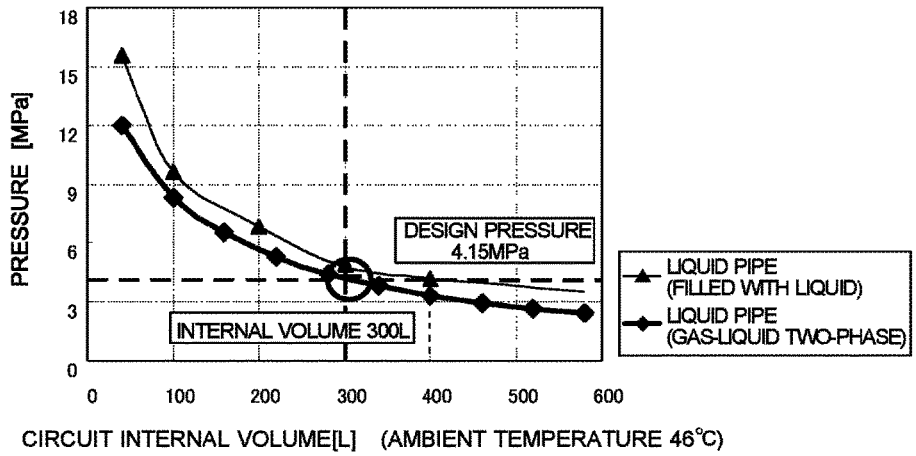
FIG. 3 is a line graph showing relations between internal volume and internal pressure in the refrigerating apparatus according to Embodiment 1 of the present invention.

FIG. 3 is a line graph showing relations between the internal volume and the internal pressure in the refrigerating apparatus according to Embodiment 1 of the present invention. The horizontal axis of FIG. 3 represents the internal volume of the low-temperature side circuit "b" except for the expansion tank 18. The vertical axis represents the pressure inside of the low-temperature side circuit "b" which is out of operation. The values shown in FIG. 3 are calculated on the assumption that the $CO_2$ refrigerant is employed in the low-temperature side circuit b, the nominal output of the low-temperature circuit compressor 5 is approximately 10 hp, the length of the liquid pipe 15 and the gas pipe 16 is 70 m, and the ambient temperature is 46 degrees C.

In addition, it is assumed that six showcases of 8 feet and two showcases of 6 feet are connected to the low-temperature circuit evaporator 12. The total internal volume of those showcases is approximately 72 liters. In FIG. 3, solid triangles (▲) indicate the relation between the internal volume and the internal pressure in the low-temperature side circuit "b" in the state where the liquid pipe 15 is filled with the liquid refrigerant. Solid diamonds (◆) in FIG. 3 indicate the relation between the internal volume and the internal pressure in the low-temperature side circuit "b" in the state where the refrigerant in the liquid pipe 15 is in the gas-liquid two-phase (in particular, with dryness of 0.1 to 0.2).

In view of FIG. 3, it is apparent that the pressure in the low-temperature side circuit "b" which is out of operation can be lowered more, the larger the internal volume of the low-temperature side circuit "b" except for the expansion tank 18 is. In addition, it is apparent that the internal volume can be reduced when the refrigerant in the liquid pipe 15 is in the gas-liquid two-phase, compared with the case where the refrigerant is in the liquid phase.

Now, it will be assumed that the total internal volume of the low-temperature circuit compressor 5, the auxiliary condenser 6, the low-temperature circuit condenser 7, the receiver 9 (approximately 40 liters in the 10 hp class), the liquid pipe 15 (70 m), the gas pipe 16 (70 m), and the low-temperature circuit evaporator 12 (approximately 72 liters with 8 showcases) is approximately 160 liters.

To set the design pressure of the low-temperature side circuit "b" so as not to exceed 4.15 Mpa under the ambient temperature of 46 degrees C., which is equivalent to the design pressure in the case of employing R410A, an internal volume of approximately 400 liters is required when the liquid pipe 15 is filled with the liquid refrigerant, according to FIG. 3. Here, the amount of the refrigerant in the low-temperature side circuit "b" in the state where the liquid pipe 15 is filled with the liquid refrigerant is approximately 30 kgs. To retain the amount of 400 liters in the refrigerating apparatus, the expansion tank 18 has to have a capacity of 240 liters, which is the difference between 400 liters and the total internal volume of 160 liters. Specifically, in the case where the tank has an outer diameter of 270 mm (wall thickness 8 mm) and a length of approximately 1500 mm, three of such tanks are necessary. However, providing three tanks leads to an increase in size of the refrigerating apparatus, as well as in cost of the expansion tanks 18 themselves.

On the other hand, in the case where the refrigerant in the liquid pipe 15 is in the gas-liquid two-phase, the internal volume necessary for setting the design pressure of the low-temperature side circuit "b" so as not to exceed 4.15 Mpa can be reduced to 300 liters, according to FIG. 3. Accordingly, it suffices that the expansion tank 18 has a capacity of 140 liters, which is the difference between 300 liters and 160 liters. Therefore, the expansion tank 18 can be built in a reduced size, and also the cost can be reduced compared with the case where the liquid pipe 15 is filled with the liquid refrigerant.

When the refrigerant in the liquid pipe 15 is in the gas-liquid two-phase, the liquid refrigerant and the gas refrigerant are flowing at a relative flow rate in the liquid pipe 15. It is known that, when the refrigerant in the liquid pipe 15 is in the gas-liquid two-phase with a dryness of 0.1 to 0.2, the ratio in area between the liquid phase and the gas phase in the cross-section of the liquid pipe 15 is approximately 0.5 each. In other words, an average density in the liquid pipe 15 through which the refrigerant in the gas-liquid two-phase with a dryness of 0.1 to 0.2 is flowing is approximately a half, compared with the case where the completely liquid-phase refrigerant is flowing, and therefore the necessary amount of the refrigerant in the gas-liquid two-phase flowing in the liquid pipe 15 is approximately half the amount of the liquid-phase refrigerant.

In this case, the amount of the refrigerant in the liquid pipe 15 is reduced to half, and therefore the amount of the refrigerant in the low-temperature side circuit "b" becomes approximately 26 kgs. Since the amount of the refrigerant is thus reduced, the capacity of the expansion tank 18 necessary for setting the design pressure in the low-temperature side circuit "b" so as not to exceed 4.15 Mpa can be reduced, as stated above.

As described above, the capacity of the expansion tank 18 necessary for setting the design pressure in the low-temperature side circuit "b" so as not to exceed 4.15 Mpa, which normally has to be increased, can be reduced by turning the refrigerant flowing in the liquid pipe 15 into the gas-liquid two-phase. The refrigerant flowing in the liquid pipe 15 can be turned into the gas-liquid two-phase by controlling the opening degree of the low-temperature side second flow control valve 14 so as to turn the refrigerant in the liquid pipe 15 into the gas-liquid two-phase, while the low-temperature circuit compressor 5 is working (at the time of startup or during the normal operation).

Although the capacity of the expansion tank 18 is calculated as above on the assumption that the ambient temperature rises up to approximately 46 degrees C., the capacity of the expansion tank 18 can be further reduced when the ambient temperature is in a normal range, such as around 32 degrees C.

The capacity of the expansion tank 18 can also be reduced by the following method. Since the $CO_2$ refrigerant suffers a smaller pressure loss than the HFC refrigerant, the diameter of the gas pipe 16 can be made finer compared with the case where the HFC refrigerant is employed. For example, while the gas pipe 16 has to have a diameter of 31.75 mm when R410A is employed with an output of 10 hp, it suffices that the gas pipe 16 has a diameter of 19.05 mm when the $CO_2$ refrigerant is employed. However, in the case of employing the pipe of the same diameter as the pipe for the HFC refrigerant (31.75 mm instead of 19.05 mm) to secure a sufficient internal volume of the pipe, the internal volume of the pipe is increased by approximately 40 liters over the pipe length of 70 m. Therefore, the internal volume of the expansion tank 18 can be further reduced to 100 liters from 140 liters.

Here, in the case where the design pressure of the low-temperature side circuit "b" is increased from 4.15 Mpa, for example up to 8.5 Mpa, a copper pipe (hair pin) of, for example, approximately 9.52 mm in diameter (wall thickness 0.8 mm) has to be employed in the plate-fin-tube low-temperature circuit evaporator 12, which leads to an increase in cost. However, setting the design pressure of the low-temperature side circuit "b" so as not to exceed 4.15 Mpa allows a hair pin of approximately 9.52 mm in diameter (wall thickness 0.35 mm) to be employed in the low-temperature circuit evaporator 12, which leads to a reduction in cost to approximately a half, in the aspect of the material cost alone.

Further, setting the design pressure of the low-temperature side circuit "b" to around 4.15 Mpa allows reduction in wall thickness of each of the low-temperature circuit compressor 5, the auxiliary condenser 6, the cascade condenser 8, the receiver 9, the liquid pipe 15, the gas pipe 16, and the expansion tank 18. Thus, the cost can be reduced.

Hereunder, the operation of the refrigerating apparatus around a long-time non-operation will be described.

In the case where the low-temperature circuit compressor 5 is not operated for a long time (longer than a predetermined period, such as a non-operation of several days for consecutive holidays or new-year holidays), the pressure in the low-temperature side circuit "b" gradually increases, as mentioned above. The controller 50 keeps monitoring the pressure in the low-temperature side circuit "b" according to the detection signal from the low-temperature circuit high-pressure side pressure sensor 19 and the low-temperature circuit low-pressure side pressure sensor 20 even while the low-temperature circuit compressor 5 is out of operation, and opens the tank electromagnetic valve 17 when the pressure in the low-temperature side circuit "b" exceeds a predetermined pressure (for example, 4 Mpa) lower than the design pressure (for example, 4.15 Mpa), to thereby collect the refrigerant in the low-temperature side circuit "b" into the expansion tank 18. Accordingly, the pressure in the low-temperature side circuit "b" can be prevented from exceeding the design pressure.

During the operation of the refrigerating apparatus, frost is generated in the low-temperature circuit evaporator 12 of the low-temperature circuit compressor 5, and therefore defrosting is performed to remove the frost. The defrosting is performed by a non-illustrated heater provided in the low-temperature circuit evaporator 12, and the low-temperature circuit compressor 5 is stopped during the defrosting. Therefore, the pressure in the low-temperature side circuit "b" gradually increases during the defrosting also.

Further, the low-temperature circuit compressor 5 is stopped, or example, also when the temperature in the showcase drops from the target temperature by a predetermined value and the thermostat is turned off, in addition to a period during the defrosting. Thus, the low-temperature circuit compressor 5 may be stopped in various occasions, and the period of the non-operation also varies depending on the situation. The low-temperature circuit compressor 5 may be stopped during the defrosting period, for a long time such as several days, or for a short time during which the thermostat is off.

When the non-operation period is short, the pressure in the low-temperature side circuit "b" does not remarkably increase even if the low-temperature circuit compressor 5 through that period. However, when the non-operation period is long, the pressure in the low-temperature side circuit "b" may have risen to a level close to the design pressure, though the pressure can be prevented from exceeding the design pressure by allowing communication between the expansion tank 18 and the low-temperature side circuit b. Accordingly, the pressure in the low-temperature side circuit "b" before the startup of the low-temperature circuit compressor 5 after the non-operation period differs depending on whether the low-temperature circuit compressor 5 is about to be activated after the period during which the thermostat has been off, or after a long-time non-operation.

Hereunder, description will be given on the state of the refrigerant in the low-temperature side circuit "b" at the time of the startup of the low-temperature circuit compressor after the non-operation period thereof.

As stated above, the pressure may have risen to a level close to the design pressure, before the startup after a long-time non-operation. According to Japanese Unexamined Patent Application Publication No. 2004-190917, the high-temperature circuit compressor 1 is first activated and then the low-temperature circuit compressor 5 is activated after a predetermined time has elapsed, because the pressure may exceed the design pressure if the low-temperature circuit compressor 5 is activated in such a state. Therefore, the pull-down rate (time it takes to lower the temperature in the showcase, which has increased during the non-operation period, to a target temperature) is lowered compared with the case where both of the low-temperature circuit compressor 5 and the high-temperature circuit compressor 1 are activated at the same time after a long-time non-operation.

With the configuration according to Embodiment 1, however, both of the low-temperature circuit compressor 5 and the high-temperature circuit compressor 1 can be activated at the same time after a long-time non-operation, and yet the pull-down rate can be improved. Such an aspect will be described in further details hereunder.

(Start Up after Long-Time Non-Operation)

Figure 4:
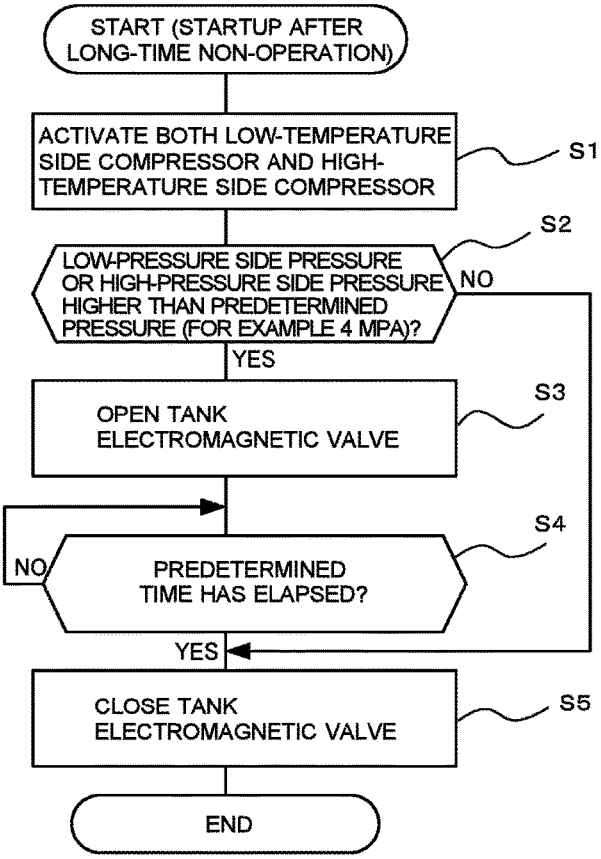
FIG. 4 is a flowchart showing a startup process after a long-time non-operation, of a low-temperature circuit compressor of the refrigerating apparatus according to Embodiment 1 of the present invention.

FIG. 4 is a flowchart showing the startup process after a long-time non-operation, of the low-temperature circuit compressor 5 of the refrigerating apparatus according to Embodiment 1 of the present invention. Referring to FIG. 4, the startup process of the low-temperature circuit compressor 5 of the refrigerating apparatus after a long-time non-operation will be described.

For the startup after a long-time non-operation, first the controller 50 activates both of the low-temperature circuit compressor 5 and the high-temperature circuit compressor 1 (S1). The controller 50 then determines whether the pressure detected by the low-temperature circuit high-pressure side pressure sensor 19 or the low-temperature circuit low-pressure side pressure sensor 20 is higher than the predetermined pressure (in this example, 4 Mpa) lower than the permissible pressure (S2). Upon deciding that the detected pressure is higher than the predetermined pressure, the controller 50 opens the tank electromagnetic valve 17 (S3). Accordingly, the refrigerant in the expansion tank 18 is collected into the low-temperature side circuit b. After a predetermined period of time has elapsed thereafter (S4), the controller 50 closes the tank electromagnetic valve 17 (S5) and finishes the startup process. After that, the normal operation is performed so as to maintain the internal space of the showcase at the target temperature.

The predetermined period of time of step S4 is set to a time necessary for the evaporation temperature to reach a target evaporation temperature for adjusting the temperature in the showcase to the target temperature in the normal operation, for example 2 to 3 minutes. Here, the low-pressure side pressure detected by the low-temperature circuit low-pressure side pressure sensor 20 may be adopted as index for the decision at step S4, instead of the predetermined period of time. Any index may be adopted provided that the index allows the decision on whether an amount of refrigerant necessary for adjusting the evaporation temperature of the low-temperature circuit evaporator 12 to the target evaporation temperature can be collected from the expansion tank 18.

In the case where the low-pressure side pressure is adopted as index, it may be determined whether the low-pressure side pressure detected by the low-temperature circuit low-pressure side pressure sensor 20 has dropped to a target pressure corresponding to the target evaporation temperature, and the tank electromagnetic valve 17 may be closed when the low-pressure side pressure reaches the target pressure. The mentioned control method prevents the pressure in the low-temperature side circuit "b" from exceeding the design pressure, even though both of the low-temperature circuit compressor 5 and the high-temperature circuit compressor 1 are activated at the same time after a long-time non-operation.

On the other hand, upon deciding that the detected pressure is below the predetermined pressure at step S2, the controller 50 closes the tank electromagnetic valve 17 (S5), and finishes the startup process. Thereafter, the normal operation is performed so as to maintain the internal space of the showcase at the target temperature.

(Start Up (Thermostat on) after Thermostat has been Off)

Figure 5:
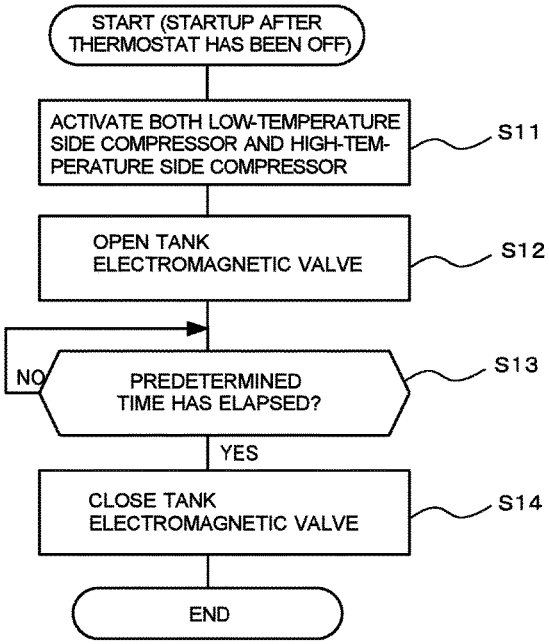
FIG. 5 is a flowchart showing a startup process after the thermostat has been off, of a low-temperature circuit compressor of the refrigerating apparatus according to Embodiment 1 of the present invention.

FIG. 5 is a flowchart showing a startup process after turning off of the thermostat, of the low-temperature circuit compressor 5 of the refrigerating apparatus according to Embodiment 1 of the present invention. Referring to FIG. 5, the startup process performed after the thermostat has been off will be described. Here, it will be assumed that the tank electromagnetic valve 17 has been closed while the thermostat has been off.

At the time of startup after the thermostat has been off, in other words at the time of turning on the thermostat, first the controller 50 activates both of the low-temperature circuit compressor 5 and the high-temperature circuit compressor 1 (S11). Since the period of time during which the low-temperature circuit compressor 5 is out of operation because of the thermostat being off is as short as approximately several minutes, the pressure in the low-temperature side circuit "b" barely increases during such a period, and hence the pressure remains sufficiently lower than the design pressure.

Here, since the low-temperature circuit compressor 5 is out of operation while the thermostat is off, the temperature in the showcase gradually increases. In this case, it is necessary to lower the evaporation temperature in the low-temperature circuit evaporator 12 to thereby enhance the cooling capability, thus lowering the temperature in the showcase down to the target temperature.

Accordingly, the controller 50 opens the tank electromagnetic valve 17 (S12) to thereby collect the refrigerant in the expansion tank 18 into the low-temperature side circuit b, thus lowering the evaporation temperature in the low-temperature side circuit b. After a predetermined period of time has elapsed thereafter (S13), the controller 50 closes the tank electromagnetic valve 17 (S14) and finishes the startup process. After that, the normal operation is performed so as to maintain the internal space of the showcase at the target temperature. The predetermined period of time of step S13 is set to a time necessary for the evaporation temperature to reach the target evaporation temperature, for example 2 to 3 minutes. Here, the low-pressure side pressure detected by the low-temperature circuit low-pressure side pressure sensor 20 may be adopted as index for the decision at step S13, instead of the predetermined period of time. Any index may be adopted provided that the index allows the decision on whether an amount of refrigerant necessary for adjusting the evaporation temperature of the low-temperature circuit evaporator 12 to the target evaporation temperature can be collected from the expansion tank 18.

In the case where the low-pressure side pressure is adopted as index, it may be determined whether the low-pressure side pressure detected by the low-temperature circuit low-pressure side pressure sensor 20 has dropped to the target pressure corresponding to the target evaporation temperature, and the tank electromagnetic valve 17 may be closed when the low-pressure side pressure reaches the target pressure.

It is preferable to select the tank electromagnetic valve 17 that is configured to be closed when power is supplied thereto, in consideration of the risk of power failure which disables the refrigerating apparatus from operating for a long time. In this case, the tank electromagnetic valve 17 is opened in the event of power failure, and therefore the refrigerant in the low-temperature side circuit "b" can be collected into the expansion tank 18 when the pressure in the low-temperature side circuit "b" increases, and the pressure in the low-temperature side circuit "b" can be prevented from exceeding the design pressure. To resume the operation after recovery from the power failure, it is preferable to open the tank electromagnetic valve 17 for a predetermined period of time (e.g., 2 to 3 minutes) so as to collect the refrigerant into the low-temperature side circuit b, before closing the tank electromagnetic valve 17.

As described thus far, providing the expansion tank 18 and the tank electromagnetic valve 17 so as to turn the refrigerant in the liquid pipe 15 into the gas-liquid two-phase state according to Embodiment 1 provides the following advantageous effects. Despite employing for example the $CO_2$ refrigerant, having a low GWP and which requires a higher design pressure than a HFC refrigerant, as operating refrigerant for the low-temperature side circuit b, the capacity of the expansion tank 18 necessary for setting the design pressure so as not to exceed 4.15 Mpa, which is equivalent to the design pressure required in the case of employing the HFC refrigerant, can be reduced though normally the expansion tank 18 has to have a larger capacity in such a case. Therefore, a refrigerating apparatus having a reduced design pressure despite employing the $CO_2$ refrigerant can be obtained at a lower cost, and consequently reduction in both design pressure and cost can be achieved.

In addition, the low-temperature side circuit "b" can be composed of general-purpose parts employed for the HFC refrigerant, and therefore the increase in cost from the HFC refrigerant-based model can be significantly suppressed despite employing the $CO_2$ refrigerant which is effective for suppressing the global warming. Here, the parts of the low-temperature side circuit "b" include the low-temperature circuit compressor 5, the auxiliary condenser 6, the cascade condenser 8, the receiver 9, the low-temperature circuit evaporator 12 (showcase, unit cooler), and the liquid pipe 15, the gas pipe 16, and the expansion tank 18 to be connected on site.

Further, the expansion tank 18 can be built in a size only approximately three times as large as the receiver 9, and the installation efficiency can be improved.

Increasing the diameter of the gas pipe 16 to the level close to that of the pipe for the HFC refrigerant allows the capacity of the expansion tank 18 to be further reduced to approximately twice as large as the receiver 9.

Further, the tank electromagnetic valve 17 is opened so that the refrigerant in the expansion tank 18 is collected into the low-temperature side circuit "b", when the pressure in the low-temperature side circuit "b" is higher than the predetermined pressure lower than the design pressure at the time of activating the low-temperature circuit compressor 5 after a long-time non-operation. Such an arrangement eliminates the need to activate the high-temperature circuit compressor 1 of the high-temperature side circuit "a" in advance in order to suppress the increase in pressure in the low-temperature side circuit "b" at the time of activating the low-temperature side circuit b, thus eliminating the need of useless operation.

Further, it is not necessary to first activate the high-temperature circuit compressor 1 and then activate the low-temperature circuit compressor 5 with a predetermined delay in order to prevent the pressure in the low-temperature side circuit "b" from exceeding the design pressure at the time of activating the low-temperature circuit compressor 5, and instead both of the high-temperature circuit compressor 1 and the low-temperature circuit compressor 5 can be activated at the same time. Therefore, the pull-down rate can be improved.

Still further, since the tank electromagnetic valve 17 is configured to be closed when power is supplied thereto, the pressure in the low-temperature side circuit "b" can be prevented from increasing in the event of power failure.

In the case where the pressure in the low-temperature side circuit "b" exceeds the design pressure while the low-temperature circuit compressor 5 is out of operation for a long time, conventionally the safety valve is opened so as to discharge the refrigerant in the low-temperature side circuit b, as mentioned above. Such a remedy has drawbacks such as necessity of replenishing the refrigerant. However, the configuration according to Embodiment 1 prevents the pressure in the low-temperature side circuit "b" from exceeding the design pressure despite the long-time non-operation, and is therefore free from such a drawback.

Embodiment 2

While Embodiment 1 represents the refrigerating apparatus configured to perform the two-stage refrigeration cycle, Embodiment 2 represents a refrigerating apparatus that employs a two-stage compressor 31.

In the refrigerating apparatus including the two-stage compressor 31 also, turning the refrigerant in the liquid pipe 41 into the gas-liquid two-phase allows the amount of the refrigerant in a circuit c (described later) to be reduced, thus enabling reduction in capacity of an expansion tank 44, as in Embodiment 1.

Figure 6:
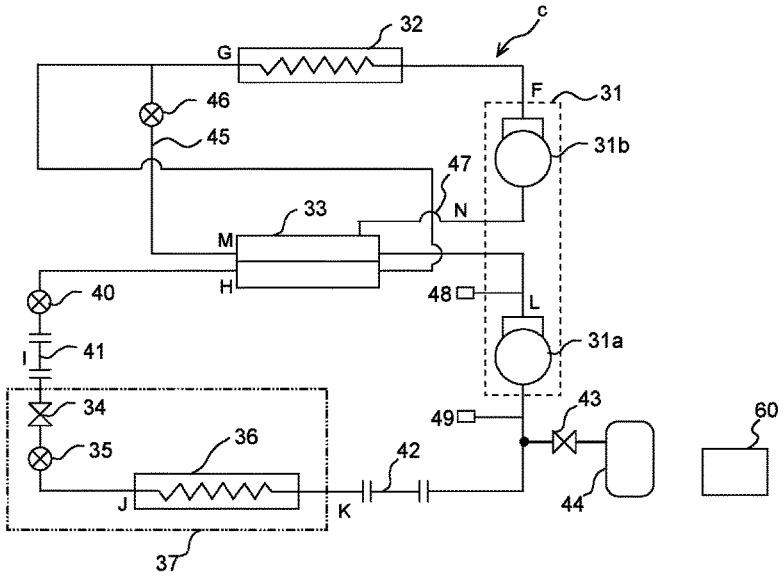
FIG. 6 is a circuit diagram showing a configuration of a refrigerating apparatus according to Embodiment 2 of the present invention.

FIG. 6 is a circuit diagram showing a configuration of a refrigerating apparatus according to Embodiment 2 of the present invention.

The refrigerating apparatus includes a circuit c composed of the two-stage compressor 31 including a lower-side compressor 31*a* and a higher-side compressor 31*b*, a gas cooler 32, an intermediate cooler 33, and a cooling unit 37 sequentially connected via a refrigerant pipe. A heat source circuit in Embodiment 2 is composed of the two-stage compressor 31, the gas cooler 32, and the intermediate cooler 33.

The cooling unit 37 includes a liquid electromagnetic valve 34, a first flow control valve 35, and an evaporator 36 connected in series, and is applicable to a showcase and a unit cooler, for example. The cooling unit 37 is connected to other refrigerant circuit parts of the circuit c via a liquid pipe 41 and a gas pipe 42. The lengths of the liquid pipe 41 and the gas pipe 42 are adjusted on the actual site where the cooling unit 37 is installed.

The circuit c also includes a second flow control valve 40 for adjusting the state of the refrigerant in the liquid pipe 41. The second flow control valve 40 is, for example, constituted of an electronic expansion valve.

In the circuit c, the expansion tank 44 is connected to the suction side of the lower-side compressor 31*a*, via a tank electromagnetic valve 43 to be opened when power is supplied thereto. The expansion tank 44 serves to suppress an increase in pressure in the circuit c when the operation is suspended, so as to prevent the pressure from exceeding the design pressure (maximum permissible pressure) despite the refrigerant in the circuit c being completely gasified.

The refrigerating apparatus also includes a branched pipe 45 branched from a position between the gas cooler 32 and the intermediate cooler 33 so as to allow the refrigerant to flow into the intermediate cooler 33, and a flow control valve for intermediate cooling 46 provided on the branched pipe 45. The refrigerating apparatus further includes a connection circuit 47 that connects the discharge side of the lower-side compressor 31*a* and the suction side of the higher-side compressor 31*b* to the intermediate cooler 33. The intermediate cooler 33 exchanges heat between the refrigerant depressurized in the flow control valve for intermediate cooling 46 and the refrigerant discharged from the lower-side compressor 31*a*, as well as between the mentioned both refrigerants and the refrigerant flowing out of the gas cooler 32 and directly flowing into the intermediate cooler 33 without passing through the flow control valve for intermediate cooling 46.

In Embodiment 2, it will be assumed that the $CO_2$ refrigerant is employed in the refrigerating apparatus.

In addition, a high-pressure side pressure sensor 48 is provided on the discharge side of the lower-side compressor 31*a*, and a low-pressure side pressure sensor 49 is provided on the suction side of the lower-side compressor 31*a*.

The refrigerating apparatus further includes a controller 60 that controls the entirety of the refrigerating apparatus. The controller 60 is constituted of a microcomputer, and includes a CPU, a RAM, a ROM, and so forth. The controller 60 receives detection signals from the high-pressure side pressure sensor 48 and the low-pressure side pressure sensor 49, and controls the tank electromagnetic valve 43 according to the detection signal. The controller 60 also controls the two-stage compressor 31, the liquid electromagnetic valve 34, the first flow control valve 35, and the flow control valve for intermediate cooling 46, according to outputs from non-illustrated other sensors.

Figure 7:
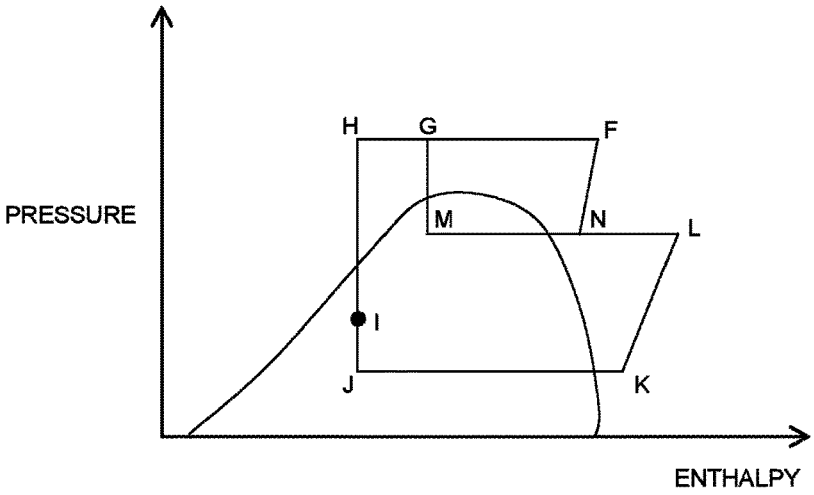
FIG. 7 is a pressure-enthalpy graph representing an operation of the refrigerating apparatus shown in FIG. 6.

FIG. 7 is a pressure-enthalpy graph representing an operation of the refrigerating apparatus shown in FIG. 6. Points F to N in FIG. 7 indicate the refrigerant status at the respective positions F to N on the pipe in FIG. 1. Referring to FIG. 6 and FIG. 7, the operation of the refrigerating apparatus will be described hereunder.

High-temperature/high-pressure gas discharged from the higher-side compressor 31*b* of the two-stage compressor 31 (point F) is cooled by the gas cooler 32 thus to be slightly subcooled (point G). The subcooled refrigerant is branched, such that the majority of the branched refrigerant (main refrigerant) undergoes a heat exchange in the intermediate cooler 33 with the remaining refrigerant (refrigerant for intermediate cooler) depressurized to the intermediate pressure (point M) in the flow control valve for intermediate cooling 46 provided on the branched pipe 45, thus to be further subcooled (point H). The main refrigerant cooled by the intermediate cooler 33 is depressurized by the second flow control valve 40 thus to be turned into the gas-liquid two-phase refrigerant (point I), and flows into the cooling unit 37 through the liquid pipe 41.

The refrigerant which has entered the cooling unit 37 passes through the liquid electromagnetic valve 34 which is opened, and is further depressurized by the first flow control valve 35 (point J), and then flows into the evaporator 36. The refrigerant which has entered the evaporator 36 exchanges heat with the air in the showcase thereby cooling the internal space of the showcase, and again turns into the low-pressure gas (point K). The refrigerant in the low-pressure gas phase is again sucked into the lower-side compressor 31*a* of the two-stage compressor 31 through the gas pipe 42, and compressed to the intermediate pressure (L). The refrigerant compressed by the lower-side compressor 31*a* to the intermediate pressure flows into the intermediate cooler 33.

As stated above, the refrigerant for intermediate cooler depressurized to the intermediate pressure (point M) also flows into the intermediate cooler 33, in addition to the refrigerant discharged from the lower-side compressor 31*a*. The evaporation of the refrigerant for intermediate cooler removes the heat of superheated vapor discharged from the lower-side compressor 31*a* and flowing into the intermediate cooler 33, and also increases the subcooling effect for the high-pressure main refrigerant flowing toward the first flow control valve 35.

In the intermediate cooler 33, in which the liquid refrigerant and vapor are mixed, the refrigerant which has entered the intermediate cooler 33 from the lower-side compressor 31*a* is cooled and dried, thus to be turned into nearly saturated vapor, and sucked into the higher-side compressor 31*b* to be compressed (point F), and then discharged.

Hereunder, description will be given on the startup process after a long-time non-operation and the startup process after the thermostat has been off. The tank electromagnetic valve 43 is controlled basically in the same manner as in Embodiment 1, in the mentioned startup process.

(Start Up after Long-Time Non-Operation)

Figure 8:
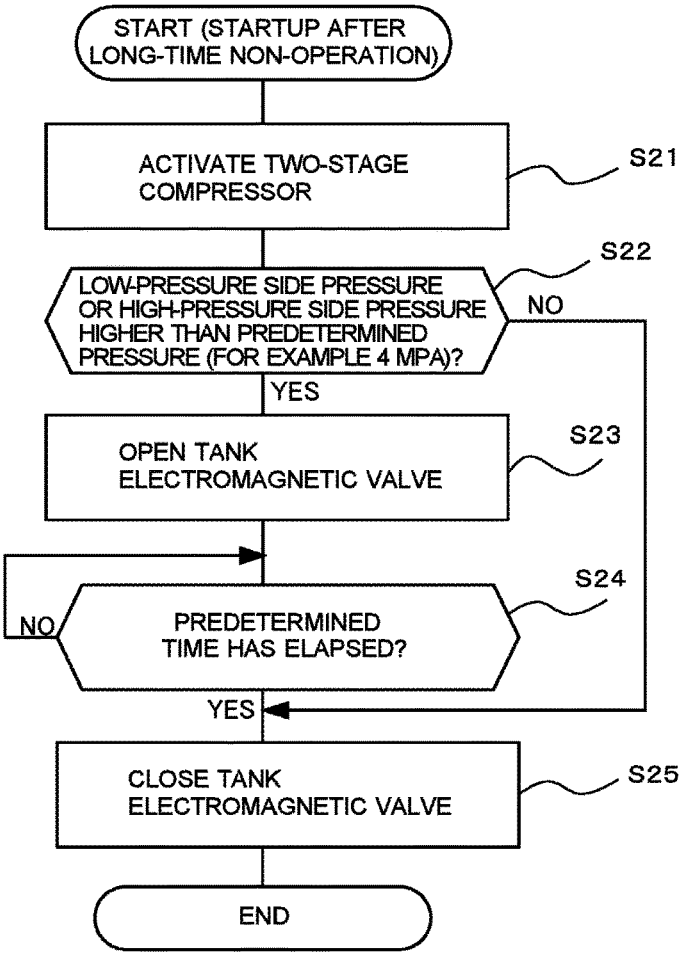
FIG. 8 is a flowchart showing a startup process after a long-time non-operation, of a two-stage compressor of the refrigerating apparatus according to Embodiment 2 of the present invention.

FIG. 8 is a flowchart showing the startup process after a long-time non-operation, of the two-stage compressor of the refrigerating apparatus according to Embodiment 2 of the present invention. Referring to FIG. 8, the operation of the tank electromagnetic valve 43 for activating the two-stage compressor 31 of the refrigerating apparatus after a long-time non-operation will be described.

For the startup after a long-time non-operation, first the controller 60 activates the two-stage compressor 31 (S21). The controller 60 then determines whether the pressure detected by the high-pressure side pressure sensor 48 or the low-pressure side pressure sensor 49 is higher than a predetermined pressure (in this example, 4 Mpa) lower than the permissible pressure (S22). Upon deciding that the detected pressure is higher than the predetermined pressure, the controller 60 opens the tank electromagnetic valve 43 (S23). Accordingly, the refrigerant in the expansion tank 44 is collected into the circuit c. After a predetermined period of time has elapsed thereafter (S24), the controller 60 closes the tank electromagnetic valve 43 (S25) and finishes the startup process. After that, the normal operation is performed so as to maintain the internal space of the showcase at the target temperature.

The predetermined period of time of step S24 is set to a time necessary for the evaporation temperature to reach a target evaporation temperature for adjusting the temperature in the showcase to the target temperature in the normal operation, for example 2 to 3 minutes. Here, the low-pressure side pressure detected by the low-pressure side pressure sensor 49 may be adopted as index for the decision at step S24, instead of the predetermined period of time. In this case, it may be determined whether the low-pressure side pressure has dropped to a target pressure corresponding to the target evaporation temperature, and the tank electromagnetic valve 43 may be closed when the low-pressure side pressure reaches the target pressure.

On the other hand, upon deciding that the detected pressure is below the predetermined pressure, the controller 60 closes the tank electromagnetic valve 43 (S25), and finishes the startup process. Thereafter, the normal operation is performed so as to maintain the internal space of the showcase at the target temperature.

(Start Up (Thermostat on) after Thermostat has been Off)

Figure 9:
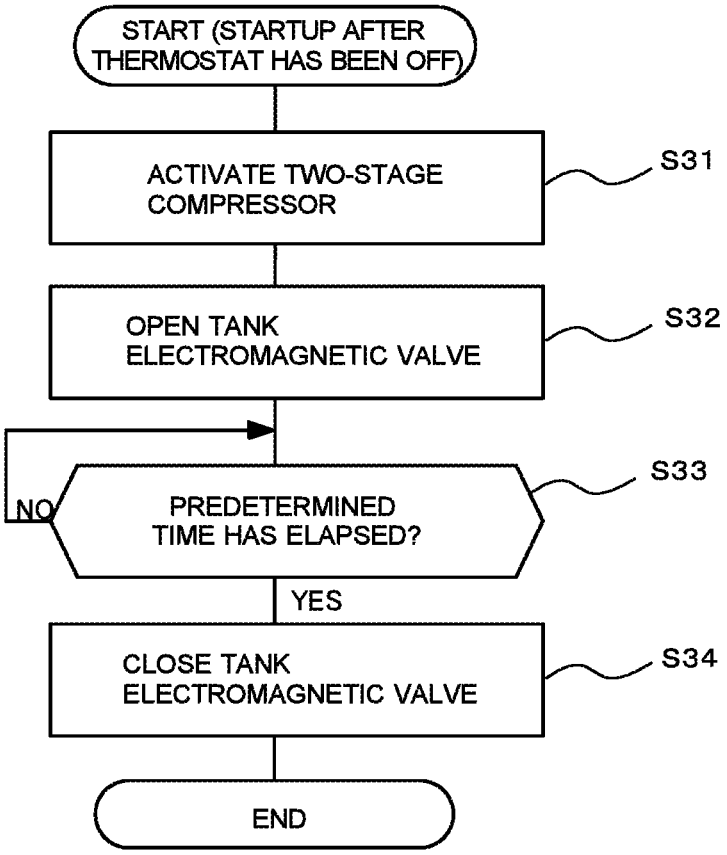
FIG. 9 is a flowchart showing a startup process after the thermostat has been off, of a two-stage compressor of the refrigerating apparatus according to Embodiment 2 of the present invention.

FIG. 9 is a flowchart showing the startup process after the thermostat has been off, of the two-stage compressor of the refrigerating apparatus according to Embodiment 2 of the present invention. Referring to FIG. 9, the startup process performed after the thermostat has been off will be described. Here, it will be assumed that the tank electromagnetic valve 43 has been closed while the thermostat has been off.

At the time of startup after the thermostat has been off, in other words at the time of turning on the thermostat, first the controller 60 activates the two-stage compressor 31 (S31). Since the period of time during which the two-stage compressor 31 is out of operation because of the thermostat being off is as short as approximately scores of minutes, the pressure in the circuit c barely increases during such a period, and hence the pressure remains sufficiently lower than the design pressure.

Here, the temperature in the showcase gradually increases while the thermostat is off. In this case, it is necessary to lower the evaporation temperature in the evaporator 36 to thereby enhance the cooling capability, thus lowering the temperature in the showcase down to the target temperature.

Accordingly, the controller 60 opens the tank electromagnetic valve 43 (S32) to thereby collect the refrigerant in the expansion tank 44 into the circuit c, thus lowering the evaporation temperature in the circuit c. After a predetermined period of time has elapsed thereafter (S33), the controller 60 closes the tank electromagnetic valve 43 (S34) and finishes the startup process. After that, the normal operation is performed so as to maintain the internal space of the showcase at the target temperature. The predetermined period of time of step S33 is set to a time necessary for the evaporation temperature to reach the target evaporation temperature, for example 2 to 3 minutes. Here, the low-pressure side pressure detected by the low-pressure side pressure sensor 49 may be adopted as index for the decision at step S33, instead of the predetermined period of time. In this case, it may be determined whether the low-pressure side pressure has dropped to the target pressure corresponding to the target evaporation temperature, and the tank electromagnetic valve 43 may be closed when the low-pressure side pressure reaches the target pressure.

It is preferable to select the tank electromagnetic valve 43 that is configured to be closed when power is supplied thereto, in consideration of the risk of power failure which disables the refrigerating apparatus from operating for a long time. In this case, the tank electromagnetic valve 43 is opened in the event of power failure, and therefore the refrigerant in the circuit c can be collected into the expansion tank 44 when the pressure in the circuit c increases, and the pressure in the circuit c can be prevented from exceeding the design pressure. To resume the operation after recovery from the power failure, it is preferable to open the tank electromagnetic valve 43 for a predetermined period of time (e.g., 2 to 3 minutes) so as to collect the refrigerant into the circuit c, before closing the tank electromagnetic valve 43.

As described thus far, in the case of employing the $CO_2$ refrigerant in the refrigerating apparatus that includes the two-stage compressor 31 as in Embodiment 2 also, the same advantageous effects as those provided by Embodiment 1 can be attained.

What is claimed is:

1. A refrigerating apparatus comprising:

a refrigeration circuit including a heat source circuit, wherein the heat source circuit has a two-stage compressor, which includes a lower-side compressor and a higher-side compressor, a gas cooler, and an intermediate cooler, and a cooling unit including a first flow control valve and an evaporator, which are connected in series to each other, a branched pipe, which is branched from a position between the gas cooler and the intermediate cooler to allow the refrigerant to flow into the intermediate cooler;

a flow control valve for intermediate cooling provided in the branched pipe;

a connection circuit connecting a discharge side of the lower-side compressor and a suction side of the higher-side compressor to the intermediate cooler;

a second flow control valve that depressurizes the refrigerant flowing out of the intermediate cooler in the refrigeration circuit and supplies the refrigerant to a liquid pipe in a gas-liquid two-phase state; and an expansion tank connected to a suction side of the lower-side compressor in the refrigeration circuit via a tank electromagnetic valve and configured to suppress an increase in pressure in the refrigeration circuit during a non-operation period, wherein the refrigeration circuit is configured to connect the heat source circuit and the cooling unit via the liquid pipe, which supplies a refrigerant from the heat source circuit to the cooling unit, and a gas pipe, which supplies the refrigerant from the cooling unit to the heat source circuit, the liquid pipe extends between the intermediate cooler and the cooling unit and is the only pipe that supplies the refrigerant from the intermediate cooler to the cooling unit, the second flow control valve regulates the refrigerant in the liquid pipe, and the refrigeration circuit is configured for a $CO_2$ refrigerant to circulate therein.

2. The refrigerating apparatus of claim 1, further comprising a controller that controls opening and closing operation of the tank electromagnetic valve according to a pressure detected by one of a high-pressure side pressure sensor, which detects a pressure on the discharge side of the lower-side compressor, and a low-pressure side pressure sensor, which detects a pressure on the suction side of the lower-side compressor, wherein the controller is configured to:

open the tank electromagnetic valve to allow the refrigerant in the refrigeration circuit to flow into the expansion tank when the detected pressure exceeds a predetermined pressure lower than a design pressure of the refrigeration circuit during the non-operation period; and activate the two-stage compressor upon activating the refrigerating apparatus, and determine whether the detected pressure is higher than the predetermined pressure in the case where the non-operation period before the startup is longer than a predetermined period and, in the case where the detected pressure is higher than the predetermined pressure, open the tank electromagnetic valve to thereby collect an amount of refrigerant necessary for adjusting an evaporation temperature in the evaporator to a target evaporation temperature, from the expansion tank into the refrigeration circuit, and then close the tank electromagnetic valve in the case where the detected pressure is equal to or lower than the predetermined pressure.

3. The refrigerating apparatus of claim 1, further comprising a controller that controls opening and closing operation of the tank electromagnetic valve according to a pressure detected by one of a high-pressure side pressure sensor, which detects a pressure on the discharge side of the lower-side compressor, and a low-pressure side pressure sensor, which detects a pressure on the suction side of the lower-side compressor, wherein the controller is configured to:

open the tank electromagnetic valve to allow the refrigerant in the refrigeration circuit to flow into the expansion tank when the detected pressure exceeds a predetermined pressure lower than a design pressure of the refrigeration circuit during the non-operation period; and activate the two-stage compressor upon activating the refrigerating apparatus, and, in the case where the startup is performed after a thermostat has been off, open the tank electromagnetic valve to thereby collect an amount of refrigerant necessary for adjusting an evaporation temperature in the evaporator to a target evaporation temperature, from the expansion tank into the refrigeration circuit, and then close the tank electromagnetic valve.

4. The refrigerating apparatus of claim 1, wherein the tank electromagnetic valve is an electromagnetic valve that is closed when power is supplied thereto.

* * * * *